United States Patent [19]

Bender

[11] 4,391,155

[45] Jul. 5, 1983

[54] RECIPROCATING DRIVE AND REVERSING MECHANISM FOR LONG STROKE, WELL PUMPING UNIT

[76] Inventor: Emil A. Bender, 6625 Kane Way, Bakersfield, Calif. 93309

[21] Appl. No.: 393,100

[22] Filed: Jun. 28, 1982

[51] Int. Cl.[3] ..... F16H 27/02; F16H 29/02; F04B 47/06

[52] U.S. Cl. ..... 74/89.2; 417/44

[58] Field of Search ..... 74/89.2, 89.21, 89.22, 74/108; 92/137; 417/44

[56] References Cited

U.S. PATENT DOCUMENTS

| | | | |
|---|---|---|---|
| 1,970,596 | 8/1934 | Coberly | 74/89.22 |
| 3,248,958 | 5/1966 | Bender | 74/89.2 |
| 3,345,950 | 10/1967 | Bender | 74/590 |
| 3,483,828 | 12/1969 | Bender | 74/590 |
| 3,777,491 | 12/1973 | Bender | 60/372 |
| 3,868,820 | 3/1975 | Lawson | 74/89.2 |
| 4,179,947 | 12/1979 | James | 74/89.2 |

*Primary Examiner*—Richard E. Gluck

*Attorney, Agent, or Firm*—Quaintance & Murphy

[57] ABSTRACT

A yo-yo variety reversing mechanism for long stroke, well pumping units, which employ a lift belt as the operative link between a winding drum and the polish rod of the well pump. Shock experienced between transfer from an upstroke to a downstroke is cushioned by the reversing mechanism or control which provides a power source off dwell period during the aforesaid stroke exchange. Further cushioning is provided by a novel winding drum for the lift belt which decreases the effective radius of the drum at the point of exchange from a downstroke to an upstroke to thus slow movement of the belt and cushion the shock of exchange from a downstroke to an upstroke.

5 Claims, 7 Drawing Figures

RECIPROCATING DRIVE AND REVERSING MECHANISM FOR LONG STROKE, WELL PUMPING UNIT

BACKGROUND OF THE INVENTION

This invention relates generally to well pumping units and more specifically to a simplified and improved drive for imparting reciprocating movement to the polish rod of the pump. The invention includes an improved and reliable reversing mechanism which provides a dwell period between an upstroke and a downstroke wherein the power source is in an off position. The dwell period may be easily adjusted to suit design and field conditions. Thus, the usual shock experienced during stroke exchange from an upstroke to a downstroke is cushioned to thereby reduce wear and tear on parts and increase the life of the unit. Additional cushioning is provided by a winding drum structure which slows reciprocation of the unit, at the point of exchange from a downstroke to an upstroke.

The invention has particular utility with a long stroke, well pump employing an electric motor as the power source. I have developed such a well pumping unit, as herein disclosed, which includes a tower mounted on a base platform, a source of power in the form of an electric motor, a winding drum on the base platform driven from the electric motor, and a lift belt made of conveyor belting from the winding drum up to the top of the tower and over a spool mounted thereon and then extended downwardly and secured to the polish rod of the otherwise conventional well pump. A counterbalance or counterweight is attached to that portion of the drive belt between the spool and the winding drum so that power requirements are kept to a minimum. An idler spool is provided in the tower and that portion of the lift belt between the counterweight and the winding drum is trained beneath the idler pulley or spool so as to eliminate any side to side movement of the counterweight during operation of the pump. The reversing mechanism and winding drum are arranged and configured to minimize the shock of exchange between an upstroke and a downstroke, at which time the power source for the winding drum reverses direction, and between a downstroke and an upstroke, at which time the lift belt is rewound upon the drum, respectively.

A brief description of the background of development of well pumping units is appropriate. In the early life of a well, reservoir pressure alone may be sufficient to lift the oil to the surface, providing local regulatory authorities permit such a procedure. However, such pressure is eventually exhausted whereupon the oil must be pumped to the surface. The most common variety of pump in use is a walking beam pump having a nominal stroke of approximately seven to 10 feet. A walking beam pump is suitable for shallow wells, but such a pump becomes inefficient and eventually inoperable with wells which are one, two or miles deep. Specifically, rod stretch may become equal to stroke distance, thus rendering a walking beam pump completely inoperable when used with a very deep well.

Thus, long stroke, well pumping units particularly useful in deep wells, have been developed, some having stroke lengths of thirty-two feet or more. An example of such a prior art long stroke pumping unit is the "Oilwell" Long Stroke Pumping Unit, made by Oilwell, a division of United States Steel. The unit includes a central tower having multiple guides to stabilize the structure, a complex multi-strand cable crown block assembly suspending the rod string, a variable capacity counterweight, and a prime mover. A wire line drum is used having a helix track operative during exchange from a downstroke to an upstroke to slow wire line travel somewhat, increase mechanical advantage on the well side of the pump, and thus reduce the shock of stroke reversal somewhat. This unit is both complex and expensive.

An improved wire line deep well pumping apparatus is disclosed and claimed in my own prior U.S. Pat. No. 3,248,958. A basic yo-yo variety of long stroke pumping unit discussed therein has a power system in which a cycle of windup (during pump upstroke) and payout (during pump downstroke) is accomplished without need for winding drum reversal; thus, the power source of the unit is reversed only after a full cycle of operation rather than with each stroke, as in prior art long stroke pumping units. As disclosed in this patent, an electric motor is used as the power source and during a downstroke, the winding drums work with the motor and thus a counter electromotive force is generated in the motor which can be employed to salvage much of the kinetic energy in the moving parts of the system. A simple limit switch is disclosed for reversing the electric motor; the patent further states that polish rod stroke and time delay may be modulated but discloses no structure or system for accomplishing such results. Another of my prior U.S. patents, U.S. Pat. No. 3,345,950 discloses a long stroke, deep well pumping unit either electrically or hydraulically powered and including a limit switch system alternately operated by the yoke suspending the polish rod and the counterweight to effect power source reversal.

Other long stroke, deep well pumping units that I have invented are disclosed in my prior U.S. Pat. Nos. 3,483,828; 3,538,777; 3,777,491; 3,792,836; and 3,986,564. FIGS. 4 and 5 of U.S. Pat. No. 3,777,491 disclose a hydraulically operated deep well pumping unit having a single, wide strap or belt as the operative connection between the polish rod and winding drum of the pump, which is somewhat similar to the lift belt of this invention.

However, the prior art does not disclose a simplified, uncomplicated long stroke, well pumping unit wherein a yo-yo drive as above discussed is employed with a flexible lift belt being the operative connection between the winding drum and the polish rod, power source reversal being positively associated with the winding drum rather than other components of the system, and stroke reversal being cushioned so as to reduce wear and tear on the unit and extend the life of the components of the unit. Of course, this unit is useful in wells of all depths, which particularly enhances the universality of application of the invention.

SUMMARY OF THE INVENTION

Therefore, it is a principal object of this invention to provide a yo-yo variety, long stroke, well pumping unit having a reversing mechanism positively associated with the winding drum of the pump unit and wherein stroke reversal is cushioned so as to ease the shock of stroke reversal on the components of the pumping unit.

It is another object of the invention to provide a yo-yo variety, long stroke, well pumping unit employing a flexible lift belt as the operative connection from the winding drum to the polish rod, the winding drum being structured and configured to reduce the effect of radius of the drum at the point of stroke reversal from a downstroke to an upstroke, thus to slow movement of the belt and ease the shock of stroke reversal.

It is yet another object of the invention to provide a yo-yo variety of long stroke, well pumping unit controlled by a reversing mechanism which provides a dwell or rest period, with the power source in an off position, between an upstroke and a downstroke, thus to ease the shock of stroke reversal.

It is a further object of the invention to provide a yo-yo variety driven, long stroke, well pumping unit having a counterweight arranged only for vertical movement and thus prevent side to side movement of the counterweight and significantly reduce lateral stresses in the system during operation of the pumping unit.

Still another object of the invention is to provide a yo-yo driven, long stroke, well pumping apparatus of greatly simplified construction which is low in cost of manufacture and easily maintained.

In general, the long stroke, well pumping unit of this invention includes a base platform, a tower on the platform, a rotatable winding drum on the platform with an electric drive, preferably, to impart rotation to the winding drum, a flexible lift belt connected at one end to the winding drum and at its other end to the upper end of the polish rod of a well pump, and a freely rotatable spool on top of the tower, over which the lift belt is trained. A counter weight is located on the lift belt, between the winding drum and the spool, and an idler pulley is located in the base of the tower, that portion of the lift belt between the counterweight and the winding drum being trained beneath the idler pulley or spool. The idler spool and upper spool arrangement generally confine counterweight movement during pumping operation to a vertical direction. A reversing mechanism or control is provided including, for example, a chain and sprocket transmission operable from the winding drum and rotating a contact for a limit switch. An end of the flexible lift belt is secured internally of the winding drum, that portion of the winding drum to either side of the flexible lift belt being curved so as to reduce the effective diameter of the drum during stroke reversal, from a downstroke to an upstroke. The structure and arrangement of both the reversing mechanism and the winding drum greatly reduce and cushion the shock of exchange from an upstroke to a downstroke and from a downstroke to an upstroke, respectively, during operation of the pump. The system is further cushioned in that at the termination of an upstroke, the power source is turned off by the reversing mechanism thus allowing the polish rod to gently fall under force of the rod string load, which is somewhat greater than that of the counterweight.

Further novel features and other objects of this invention will become apparent from the following detailed description, discussion and the appended claims taken in conjunction with the accompanying drawings.

BRIEF DESCRIPTION OF THE DRAWINGS

A preferred structural embodiment of this invention is disclosed in the accompanying drawings in which.

DESCRIPTION OF THE PREFERRED EMBODIMENT

Figure 1:
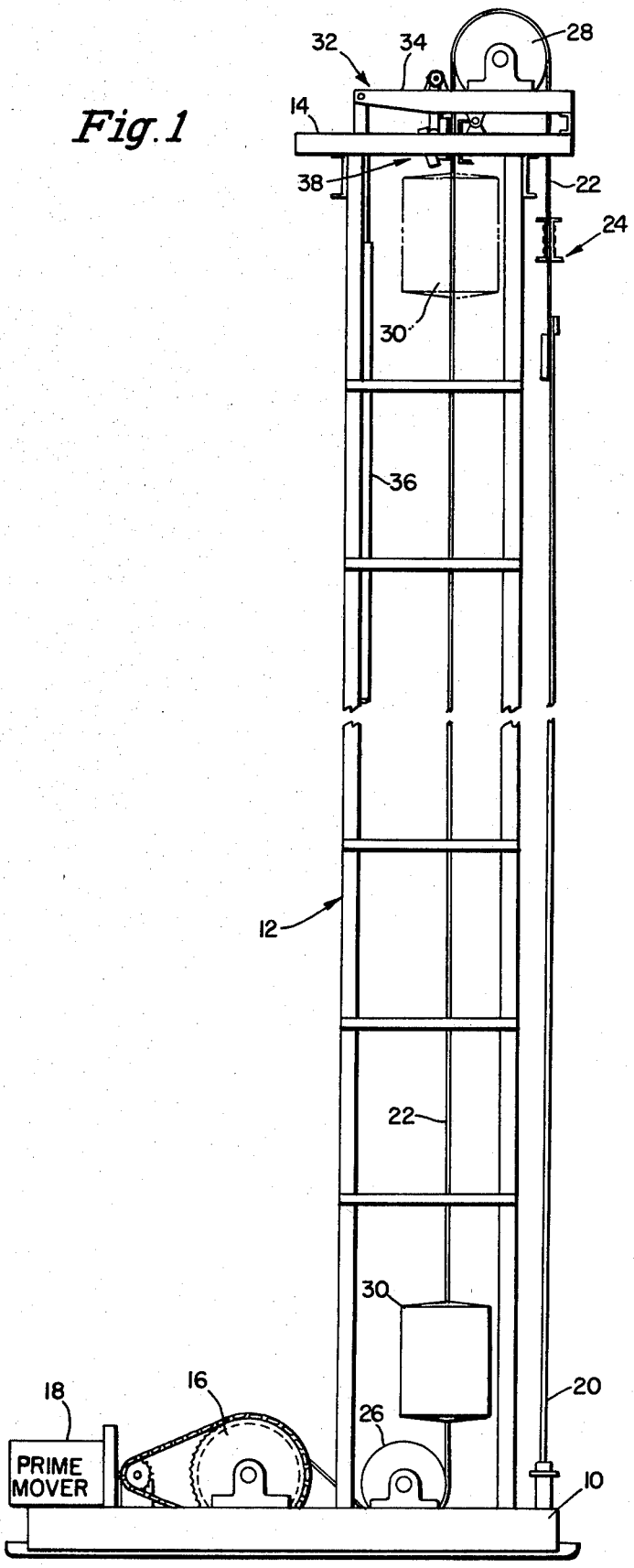
FIG. 1 is a partial, side elevation view of a well pumping unit of this invention.

Referring now to the drawings by reference character, and in particular to FIG. 1 thereof, a simplified, long stroke, well pumping unit is illustrated. A skid mounted base platform 10 supports a tower structure 12. A top platform 14 surmounts the tower structure 12. A rotatable winding drum 16 is located on base platform 10 and is driven by a drive belt arrangement from a power source 18 which,in a preferred embodiment of the invention, is a reversible, electric motor. An otherwise conventional well pump (not shown) includes a rod string and sucker rod therein, topped by a conventional polish rod 20. A flexible lift belt 22 is secured at one end to rotatable winding drum 16 and at its other end to a yoke assembly 24 from which the polish rod 20 is centrally suspended. Flexible lift belt 22 is reaved beneath an idler pulley or spool 26 on base platform 10, then upwardly through tower 12, to and over a spool 28, freely rotatably mounted atop the top platform 14, and then vertically downwardly to yoke assembly 24. A counterweight 30 is attached to or interposed within lift belt 22 and reciprocates generally vertically, with movement of lift belt 22, between the upper and lower ends of the tower structure 12. It can be seen that the location and arrangement of spool 28 with respect to idler pulley 26 generally confine movement of the counterweight 30 to a vertical direction. Thus, side to side movement of counterweight 30 during operation of the pump, which motion induces unnecessary lateral strains in the entire unit, is effectively reduced.

A fail safe mechanism 32 is located on top platform 14 and, in the event of failure by fracture of that portion of the lift belt generally between spool 28 and yoke 24 or of yoke 24, polish rod 20 or one of the components of the rod string, is operable to immediately grasp and clamp that portion of belt 22 between spool 28 and counterweight 30 and thus prevent counterweight 30 from falling. Fail safe mechanism 32 includes a lever platform 34, a counterweight 36, and a safety brake system 38. Upon failure of a component as just described, rod string and counterweight load on spool 28 are suddenly released whereupon counterweight 36 will rotate lever platform 34 in a counterclockwise direction, in the sense of FIG. 1, whereupon brake system 38 is mechanically forced to tightly clamp and engage belt 22 therewithin and prevent counterweight 30 from falling.

Commercially available conveyor belting may be employed of the material for lift belt 22. One available brand of conveyor belting that might be used is that sold under the trademark "UNILOK" as "PolyVinylok" conveyor belting. One particular material found to be useful is Unilok's PVK-350 Material, a belting that is 10/32 inches thick, 15 inches wide and has an ultimate tensile strength at rupture of 3500 pounds per inch.

Similar materials sold under this same mark are available, up to 15/32 inches thick and having an ultimate tensile strength at rupture of up to 9000 pounds per inch. Belt widths may vary from 15 inches to 24 inches or more. The particular belting material chosen will, of course, depend on the design requirements of the particular well pumping unit.

Figure 3:
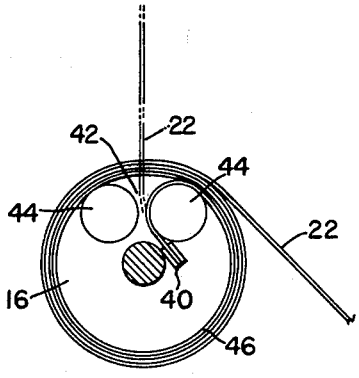
FIG. 3 is a section view of the winding drum of this invention.

With reference to FIG. 3, the novel winding drum of this invention is illustrated in cross section. An end of the flexible lift belt 22 is securely attached at 40 within winding drum 16. Belt 22 extends outwardly from the drum through a slot 42 defined by a pair of smaller but equal diameter cylinders 44, 44, on either side of slot 42. The surfaces of the cylinders 44 are smoothly blended into the larger diameter cylinder 46 forming the main body of winding drum 16. Flexible belt 22 has a dimension such that, at the end of the down stroke, with yoke 24 in a lowermost position, flexible belt 22 is completely paid out from the drum 16. At this point, winding drum 16 continues to rotate in the same direction as during the pay out of flexible belt 22, thus to initiate a winding up of flexible belt 22 upon drum 16 and thereby initiate a pump up stroke. Due to the structure of cylinders 44, it can be seen that during the terminal stage of a down stroke and the initial stage of an upstroke, the effective radius of the drum cylinder is reduced. Consequently, the velocity of movement of belt 22 is slowed with an increased mechanical advantage on the well side of the pump and the shock of transition from a downstroke to an upstroke, and the power source 18 coming under load, is significantly reduced.

Figure 2:
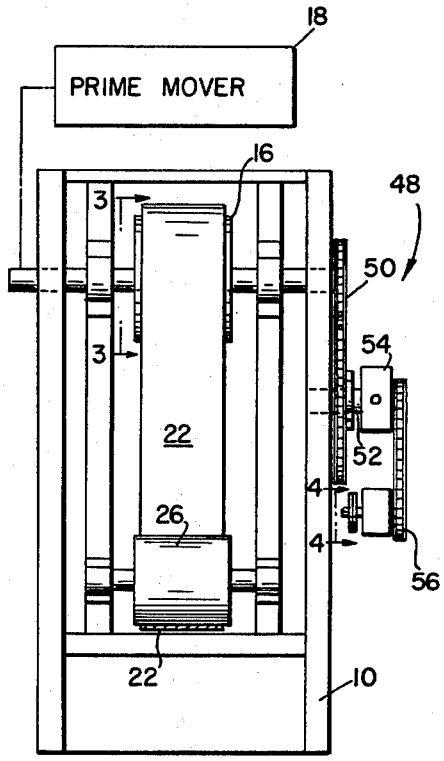
FIG. 2 is a diagrammatic, top plan view of the base platform of the pumping unit shown in FIG. 1, with the tower structure and related components removed for purposes of clarity.
Figure 5:
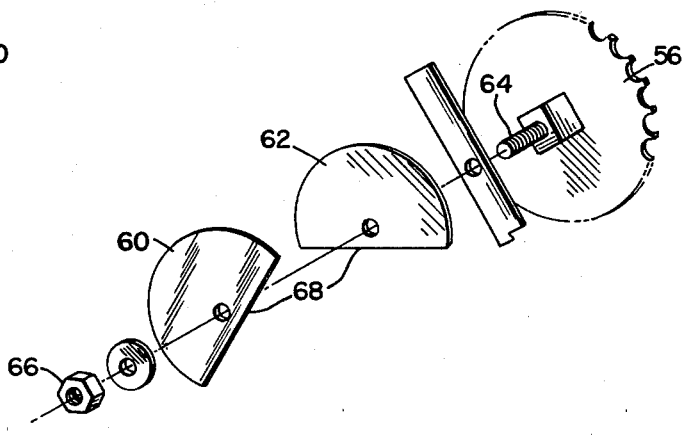
FIG. 5 is an exploded perspective view of the reversing mechanism control illustrated in FIG. 4.

Referring now to FIG. 2 of the drawings, the reversing mechanism of this invention is generally indicated by reference numeral 48. A chain and sprocket transmission 50 is operable from winding drum 16 through an idler shaft 52 and reduction gear box 54 to a second chain and sprocket transmission 56 and reversing control unit 58. Obviously, as an alternative, a single chain and sprocket connection from winding drum 16 to control unit 58 could be provided. The reversing control unit 58 is illustrated in detail in FIG. 5. A pair of segmented circular plates 60, 62, which may be identically dimensioned, are attached through their respective centers to a stud axle 64 which is rotated by chain and sprocket transmission 56, as shown. Plates 60, 62 are rotatably adjustable with respect to each other, by loosening stub axle nut 66, adjusting the plates so that their respective chords form an open notch 70 of predetermined dimensions, and then retightening nut 66 in place.

Figure 4A:
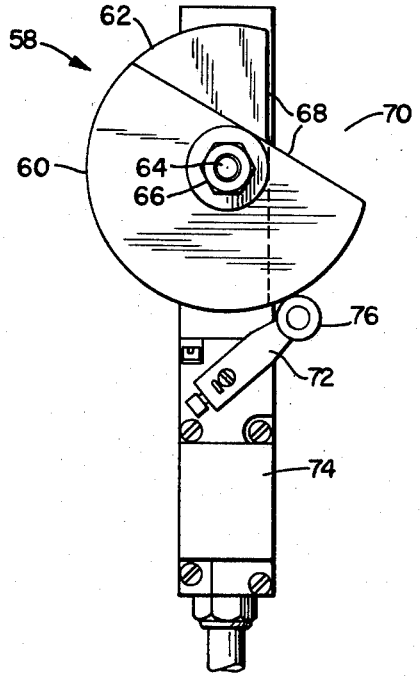
FIGS. 4A, 4B and 4C are elevation views of the reversing mechanism, limit switch contact assembly which controls power source reversal of the pumping unit, the three views illustrating the three positions of the limit switch during pump operation.
Figure 4B:
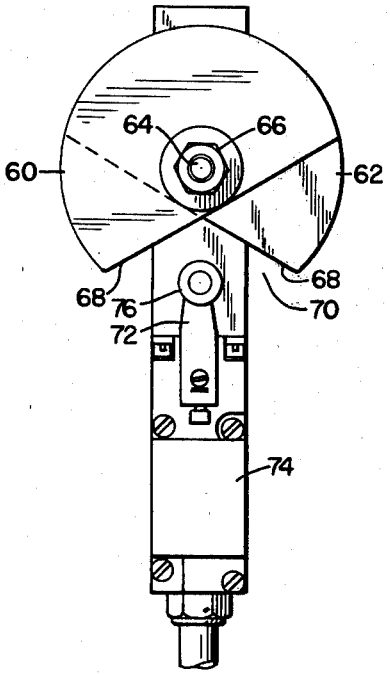
Figure 4C:
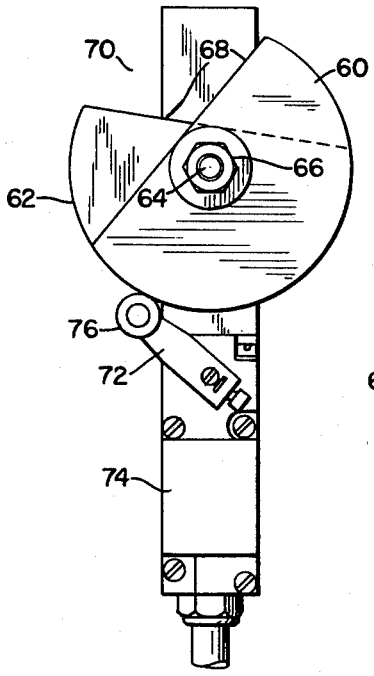

Referring now to FIG. 1 and FIGS. 4A, 4B and 4C, the yo-yo operation of the invention will now be described. For convenience of discussion, a cycle begins with counterweight 30 in its lowermost position, yoke 22 and polish rod 20 in their uppermost position and flexible belt 22 being wound as fully as it ever will be upon drum 16. In short, a downstroke is about to begin. At this stage in the cycle, the reversing control unit is positioned as illustrated in FIG. 4B with notch 70 embracing, but out of contact with, finger 72 of a three position, spring loaded limit switch 74. In this embodiment, the power source is a reversible electric motor. Limit switch 74 may be of any conventional, commercially available type, such as a Cutler Hammer E50 SN Limit Switch. Of course, limit switch 74 is suitably, conventionally connected to power source 18. As shown in FIG. 4B, finger 72 of limit switch 74 is in a vertical, neutral position; thus, the electric motor comprising the power source 18 is in a power off position. Counterweight 30 has previously been weighted so that polish rod load exceeds the load generated by the counterweight. Thus, yoke 24 and polish rod 20 will begin to descend, thus initiating a downstroke. As this occurs, drum 16 is forced to rotate in a counterclockwise direction, in the sense of FIG. 1, as flexible belt 22 is paid out therefrom. Simultaneously, plates 60, 62 of reversing control unit 58 are caused to rotate counterclockwise because of the chain and sprocket transmission connection to winding drum 16. The reversing control unit 58 then assumes the position illustrated in FIG. 4A, with limit switch finger 72 moved to the right which turns the power source motor to one of its on positions. Finger 72 includes a freely rotatable roller 76 at the free end thereof which first contacts a chord 68 of plate 62 whereupon the upper part of finger 72 is forced to rotate to the right and turn the switch 74 to an on position as roller 76 approaches the periphery of plate 62. Switch 74 is maintained in a first on position as the down stroke continues and plates 62, 60 continue their counterclockwise rotation, with roller 76 riding about the periphery of plates 60, 62.

It is important to note that as the downstroke continues and with power source motor 18 turned on, as just described, the winding drum 16 works with the motor and thus a counter electromotive force is generated in the power source motor 18 which may be used to salvage much of the kinetic energy in the moving parts of the system; in short, the motor acts as a generator as the down stroke continues, in a manner well known in the electrical art.

As the downstroke nears an end, plates 60, 62 will have rotated about 180 degrees from the initial position shown in FIG. 4B. At this point, all of the flexible belt 22 will be unwound from drum 16 but the drum will continue to rotate in a counterclockwise fashion thus initiating an upstroke as flexible belt 22 is rewound upon drum 16. Since the limit switch remains in the position illustrated in FIG. 4A, the power source 18 then runs under load and the counterweight travels from the position indicated in phantom lines at the top of the tower to the position shown in the bottom of the tower in solid lines. Thus, a full cycle of a down stroke and an up stroke is accomplished without need for reversal of rotation of winding drum 16 and consequently of the motor 18 as well. At the completion of the upstroke, plates 60, 62 will have rotated through about 360 degrees and again assume the position illustrated in FIG. 4B, whereupon the power source motor 18 will be in a power off position. The amount of time alloted to this power on position is predetermined by adjustment of plates 60, 62 as above described to set the dimensions of notch 70. Obviously, the smaller the notch, the longer the power on period will be and vice versa. Accordingly, the stroke distance of the unit may be adjusted by relative adjustment of the plates 60, 62 as aforesaid. Due to the polish rod load being in excess of the load generated by counterweight, the rod string again falls, to thereby initiate a second downstroke. At this point, flexible belt 22 will begin to unwind from drum 16 and drum 16 will now rotate in a clockwise direction. Consequently, plates 60, 62 of reversing control unit 58 will also be caused to rotate in a clockwise direction, to assume the position illustrated in FIG. 4C. At this point, switch 74 has been moved to a second, power on position. Additionally, the motor again acts as a generator, as above described. As the downstroke is terminated, drum 16 continues to rotate in a clockwise direction thus rewinding flexible belt 22 thereon without reversal of the direction of rotation of winding drum 16 and with power source motor 18 under load to effect a second upstroke. At the termination of this up stroke, the control unit again assumes the attitude illustrated in FIG. 4B and the first of the two cycles just described is initiated again. Thus, it is seen that only one drum and motor reversal is required for two strokes or one cycle of pump operation.

In one embodiment of the invention, a pumping unit is dimensioned to provide a 25 foot stroke in polish rod 20. This is economically practical because commonly available, off-the-shelf components may be interfaced with the unit. For example, a standard long stroke pump is thirty feet long and has a plunger 5 feet in length. Additionally, standard polish rods and standard rods making up the rod string are compatible with a pump having a 25 foot stroke.

A comparison of the production figures of a standard walking beam pump unit with a long stroke pumping unit herein disclosed yields the following interesting results. In pumping a well about one mile deep, a standard walking beam unit with a 10-foot stroke and operating at 8 strokes per minute will produce a net lift per minute of 40 feet, when a rod stretch of 5 feet on the lift stroke is taken into account. Conversely, use of a pumping unit as above disclosed, with a 25-foot stroke and operating only at 4 strokes per minute, yields a net lift per minute of 80 feet, again taking the 5 feet of rod stretch on the lift stroke into account. Thus, in this comparison, the present invention is 100 percent more efficient.

Equally importantly, the long, slower, half speed stroke just described reduces the number of cycles required per minute and extends rod and tubing life by distributing wear over a greater area. The following table sets forth numbers of strokes and cycles per selected units of time dependent upon the number of strokes or cycles per minute selected in the design of a particular unit.

STROKE AND CYCLE INFORMATION ON DEEP WELL PUMPING UNIT

| STROKES | | | | | CYCLES OR REVERSALS | | | | |
|---|---|---|---|---|---|---|---|---|---|
| Min. | Hour | Day | Month | Year | Min. | Hour | Day | Month | Year |
| 1 | 60 | 1440 | 43,200 | 525,600 | 2 | 120 | 2880 | 86,400 | 1,051,200 |
| 2 | 120 | 2880 | 86,400 | 1,051,200 | 4 | 240 | 5760 | 172,800 | 2,102,400 |
| 3 | 180 | 4320 | 129,600 | 1,576,800 | 6 | 360 | 8640 | 259,200 | 3,153,600 |
| 4 | 240 | 5760 | 172,800 | 2,102,400 | 8 | 480 | 11520 | 354,600 | 4,204,800 |
| 5 | 300 | 7200 | 216,000 | 2,628,000 | 10 | 600 | 14400 | 432,000 | 5,256,000 |
| 6 | 360 | 8640 | 259,200 | 3,153,600 | 12 | 720 | 17280 | 518,400 | 6,307,200 |

It can be readily appreciated from the table that, over a years' time when the count of cycles numbers in the millions that a long stroke unit designed in accordance with the principals of this invention will have an operating life far longer than that of prior art pumping units, such as a walking beam pump operating at twice the speed of the pumping unit of this invention, or greater.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed and desired to be secured by Letters Patent is:

1. A long stroke, well pumping unit comprising: a base platform; a tower on the base platform; drive train means including rotatable, winding drum means on the base platform and power means to rotate the drum means; a flexible lift belt attached at one end to the drum means and at its other end to the polish rod of a pump; a freely rotatable spool mounted atop the tower, the belt being trained over the spool; a counterweight attached to that portion of the lift belt between the spool and the rotatable drum; and means for reversing the power means, thus to cyclically wind and unwind the belt from the winding drum and thus impart reciprocating movement to the polish rod of a pump, said reversing means including: rotary motion transmission means responsive to rotation in the drive train means; control means responsive to said transmission means; and a three position limit switch operable from said control means, the switch being arranged to cause the power means to rotate the winding drum clockwise in a first position and counterclockwise in a second position, the third position of the switch being an off position and providing a dwell or rest period between reversals of said power means, the control means being arranged to move the limit switch to the third position when the counterweight is in its lowermost position and to maintain the limit switch in one of the first or second positions at all other times.

2. In a long stroke, well pumping unit including a base platform, a tower on the base platform, drive train means including rotatable winding drum means on the base platform and power means to rotate the drum means, a flexible lift belt attached at one end to the drum means and at its other end to the polish rod of a pump, a freely rotatable spool mounted atop the tower, the belt being trained over the spool, a counterweight attached to that portion of the lift belt between the spool and the rotatable drum; means for reversing the power means, thus to cyclically wind and unwind the belt from the winding drum and thus impart reciprocating movement to the polish rod of a pump; said reversing means including: rotary motion transmission means responsive to rotation in the drive train means; control means responsive to said transmission means; and a three position limit switch operable from said control means, the switch being arranged to cause the power means to rotate the winding drum clockwise in a first position and counterclockwise in a second position, the third position of the switch being an off position and providing a dwell or rest period between reversals of said power means, the control means being arranged to move the limit switch to the third position when the counterweight is in its lowermost position and to maintain the limit switch in one of the first or second positions at all other times.

3. The reversing means as claimed in claims 1 or 2 wherein the control means comprise rotatable, notched, generally circular plate means and the limit switch includes a contact finger arranged to ride about the periphery of the circular plate means when the limit switch is in the first or second position, the contact finger being positioned within the notch when the limit switch is in the third position.

4. The reversing means as claimed in claim 3 wherein the circular plate means comprise a pair of segmented circular plates with their centers arranged on a common axis, the notch being formed by the chords of the plates forming the segments intersecting one another, the plates being rotatably adjustable with respect to each other, thus to adjust the on time of the power means.

5. The reversing means as claimed in claim 3 wherein the rotary motion transmission means comprise a chain and sprocket speed reduction transmission driven by the winding drum whereby the control means rotates through no more than 360 degrees for each cycle of reciprocation or for one up and one down stroke of the polish rod.

* * * * *